US005683308A

United States Patent [19]

Monette

[11] Patent Number: 5,683,308

[45] Date of Patent: Nov. 4, 1997

[54] GOLF CLUB

[76] Inventor: David G. Monette, 6918 NE. 79th Ct., Portland, Oreg. 97218

[21] Appl. No.: 608,514

[22] Filed: Feb. 28, 1996

[51] Int. Cl.[6] ..... A63B 53/10; A63B 53/12

[52] U.S. Cl. ..... 473/318

[58] Field of Search ..... 473/318, 320, 473/321, 332, 312, 316, 297

[56] References Cited

U.S. PATENT DOCUMENTS

| | | | |
|---|---|---|---|
| 1,125,029 | 1/1915 | Lard | 473/300 |
| 1,821,191 | 9/1931 | Robinson | 473/312 |
| 3,317,211 | 5/1967 | Debski | 473/256 |
| 3,318,602 | 5/1967 | Kunihisa | 473/232 |
| 3,516,673 | 6/1970 | Estes | 473/256 |
| 3,625,513 | 12/1971 | Ballmer | 473/310 |
| 4,090,711 | 5/1978 | Amato | 473/232 |
| 4,961,576 | 10/1990 | Meredith | 473/323 |
| 5,131,652 | 7/1992 | Peng | 273/73 J |
| 5,478,075 | 12/1995 | Saia | 473/318 |

*Primary Examiner*—Sebastiano Passaniti
*Assistant Examiner*—Stephen L. Blau
*Attorney, Agent, or Firm*—Klarquist Sparkman Campbell Leigh & Whinston, LLP

[57] ABSTRACT

A golf club is disclosed having a shaft fixedly connected to a grip and a head. The shaft is comprised of a tube with a rod extending through the tube. The rod is fixedly attached to the head and the grip. Various nonresilient disks are located around the rod to assist in connecting the rod to the grip. Further, resilient disks are located about the rod between the grip and the head to inhibit transverse motion of the rod within the shaft and to attenuate various modes of vibration.

29 Claims, 1 Drawing Sheet

GOLF CLUB

BACKGROUND OF THE INVENTION

1. Field of the Invention

This invention pertains to golf clubs.

2. Description of the Related Art

Classical game theory states that a game should be easy to learn and difficult to master. Few games meet these requirements as well as golf. What appears to be a simple matter of striking a stationary golf ball onto a green and then into a hole actually requires substantial skill and precision. During a typical "good" golf shot, the golf club head can reach speeds of 100 miles per hour giving the golf ball an initial velocity of approximately 150 miles per hour and a spin rate of more than 5,000 r.p.m. If the club face is off center by even 2 degrees, a 250 yard drive will be off target by as much as 25 feet (includes effects of ball spin).

There are three systems at work during a golf shot: the golfer, the golf club, and the golf ball. The golfer swings the golf club, impacting the golf ball causing it to be propelled into the air with a substantial backspin, which, on a dimpled golf ball surface, generates lift. Preferably, the ball goes straight and has no side spin. Additionally, it is preferable to hit the golf ball at the "sweet spot" of the club head which correlates with a spot on the face of the head which is aligned along an axis perpendicular to the face and extends through the center of mass of the head. Hitting the golf ball outside the sweet spot can cause the golf club to twist along its shaft.

The impact between the golf ball and the club head lasts approximately $500\times10^{-6}$ seconds. The result of this impact is that the ball is projected downrange (hopefully) and the golf club receives an impact load on the club face. This loading causes a vibrational response in the golf club which is perceivable by the golfer and becomes a basis of feedback by which golfers correct their subsequent strokes. Accordingly, the vibrational response of the golf club is important.

The impact of a golf club against the golf ball creates many vibrational modes in the golf club shaft. Each mode is identified by its resonant frequency. Modes can be ordered from simple to complex where the simplest vibrational mode is the head oscillating relative to the handle, i.e., the club shaft would be bending into a "C" configuration (i.e., 2 nodes). A more complex vibrational mode would be the situation in which the club shaft oscillates in an S-shaped configuration (3 nodes). Higher modes of vibration have more complex vibration patterns and more nodes.

What is needed is a golf club that provides usable feedback to a golfer to enable the golfer to sense the club's impact with a golf ball to allow the golfer to make corrections upon subsequent golf shots.

SUMMARY OF THE INVENTION

The present invention solves the aforementioned problems by providing a golf club having a shaft coupled to a head. The shaft is comprised of a tube with a coaxially arranged rod that is coupled to the head and to a grip area at the top of the shaft.

Preferably, the shaft also includes several resilient disks that are placed around the rod at various locations along its length. The disks are sized so that they fit snugly within the inner diameter of the tube and, thereby, substantially reduce lateral motion of the rod and attenuate certain frequencies of vibration.

Various advantages and features of novelty which characterize the invention are particularized in the claims forming a part hereof. However, for a better understanding of the invention and its advantages, reference is made to the drawings and the accompanying description in which there is illustrated and described preferred embodiments of the invention.

DETAILED DESCRIPTION OF THE PREFERRED EMBODIMENTS

Figures 1, 2, 3, 4, 5:
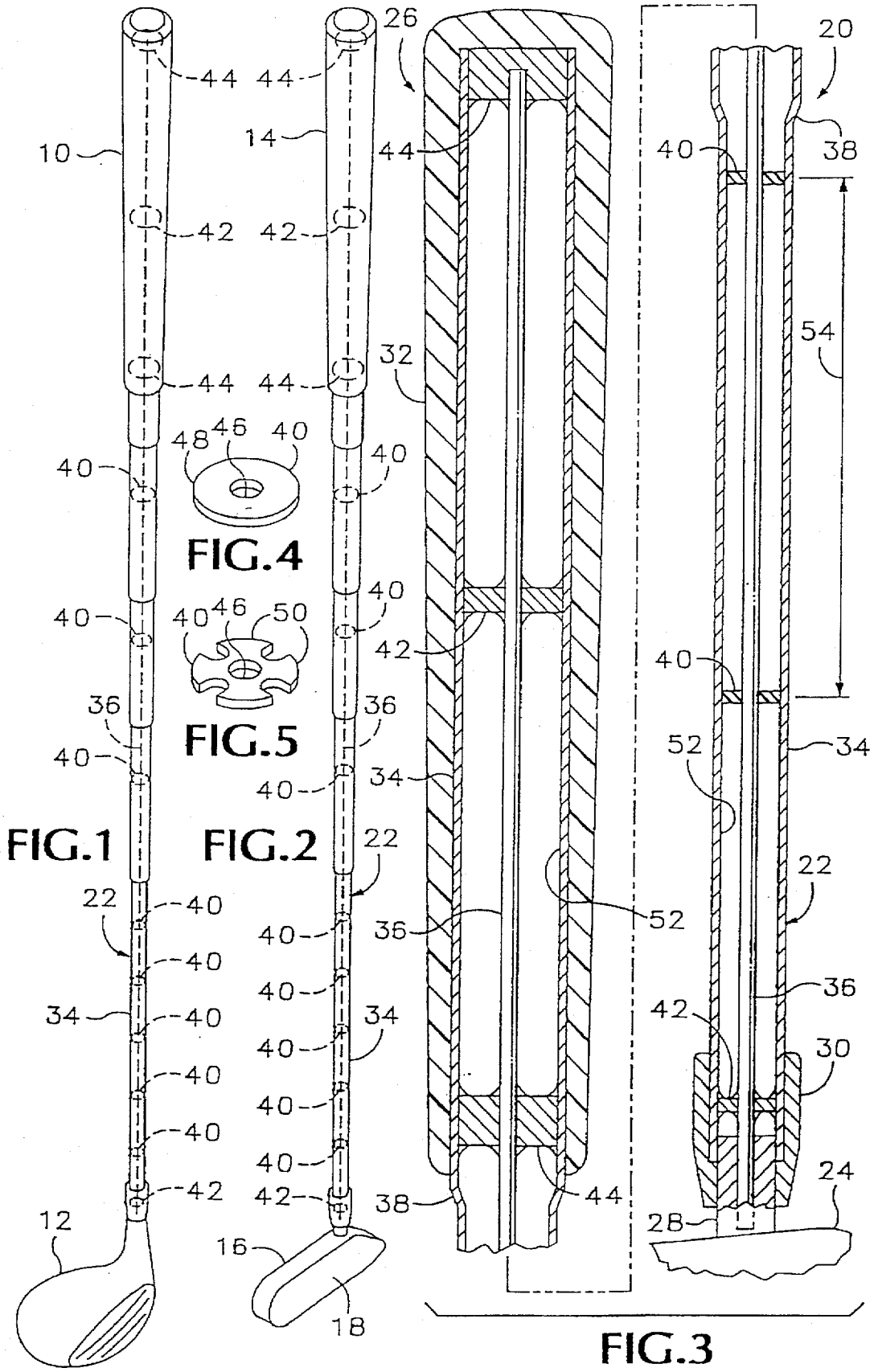
FIG. 1 is a schematic perspective view of a driver type of golf club in accordance with the present invention.
FIG. 2 is a schematic perspective view of a putter type of golf club in accordance with the present invention.
FIG. 3 is an enlarged cross-section view of a golf club of the present invention.
FIG. 4 is a perspective view of a preferred embodiment of a resilient disk.
FIG. 5 is perspective view of an alternative embodiment of a resilient disk.

The "feel" of a golf club primarily relates to tactile sensations at the golfer's hand when the club hits a golf ball. These tactile sensations occur because of forces acting on the golf club, namely, the impact of the golf club head against a golf ball. This impact, which is estimated to last $500\times10^{-6}$ seconds, provides an impulse force to the golf club head which generates vibrations that are conducted up the golf club and through the grip to the golfer's hands. Whether the vibrations can be correlated with, and distinguished between, good and bad shots determines whether the feedback information is useful to the golfer to correct his or her next shot. The present invention is believed to provide more accurate and useful sensory feedback by its unique combination of features.

Preferred embodiments of the present invention are shown in FIGS. 1–3. FIG. 1 shows the invention applied to a driver 10, which is a club having a relatively longer length and a large head 12 that is made of either wood or metal. FIG. 2 shows the invention applied to a putter 14 which is characterized a relatively shorter length and a head 16 having a perpendicular face 18. FIGS. 1 and 2 are not drawn to scale but are drawn to emphasize the overall arrangement of features of the invention. Although not separately shown, the present invention can be applied to all other types of golf clubs including "irons" and "woods".

FIG. 3 shows an enlarged cross-section view emphasizing the ends of a golf club 20. The middle portion is omitted. The golf club 20 includes a shaft 22 having one end connected to a head 24 and an opposite end that forms a grip portion 26.

The head 24 includes a hosel 28 which is fixedly connected in a conventional manner to the shaft 22. The head/shaft connection may also include a conventional sleeve 30.

The grip portion (or simply grip) 26 is shown as an extension of the shaft 22 having a cover 32 which is preferably made of a comfortable, resilient, high-friction material such as natural or synthetic rubber. Alternatively, the grip could comprise a separate member fixedly attached to the shaft 22. Preferably, the grip 26 is not perforated along its length.

The shaft 22 is comprised of a tube 34 and a rod 36 coaxially centered therein. The tube 34 extends from the hosel 28 a sufficient length so that an end portion thereof forms part of the grip 26. The tube 34 may include various steps 38 so that the outside diameter of the tube 34 tapers inwardly from the grip 26 to the head connection. The inside diameter of the tube 34 also tapers inwardly from the grip to the head connection.

The tapered or stepped tube 34 may be similar to conventional golf club shafts. The tube 34 may be steel, graphite/resin composite, or other suitable material which has the required characteristics of strength and rigidity.

The rod 36 preferably is a cylindrical or tubular member. A brass rod has been used in prototype golf clubs with satisfactory results, although other materials may prove more suitable for particular applications or types of clubs.

The preferred embodiment of the shaft 22 also includes a plurality of disks 40, 42, and 44. The disks are annular and include an aperture 46 sized to receive the rod. Preferably, disks 40 are made of a resilient material such as neoprene, rubber, or even nylon. Two possible embodiments of the resilient disks 40 are shown in FIGS. 4 and 5. FIG. 4 shows a flat, circular disk having the aperture 46 and a circular outer surface 48. FIG. 5 shows another embodiment of a resilient disk 40 also having the centrally located aperture 46. However, the disk 40 in FIG. 5 includes a plurality of lobes 50 located about its annular outer surface. Alternatively, the disks 40 could have a square, triangular, or any other shape which snugly receives the rod 36 and yet is able to snugly rest or push against an inner surface 52 of the tube 34, thereby stabilizing the rod coaxially within the tube.

The disks 40 may be sized so as to resiliently grip the rod 36 and snugly engage the inner surface 52 in a press fit manner. Alternatively, the disks 40 may be adhered in place or otherwise firmly coupled to the rod and tube. It is not desirable for the connections between the disk and rod or disk and tube to be loose. Stated differently, it is not desirable for the disk to move longitudinally relative to the tube or rod.

In the present embodiment, the disks 40 are shown at even intervals 54. Experimental designs have placed the interval 54 at approximately 1 to 2 inches along the lower portion and approximately 4 to 5 inches near the top but below the handle. This spacing and number of disks may be optimized to suit the circumstances and, for example, may be dependent on club length, tube composition, rod composition, disk composition, shaft diameter, and other variables. For example, the size and mass of the club head may have a bearing on the optimum number and spacing of the disks.

In the preferred embodiment shown, the rod is fixedly connected to the hosel 28 and to the tube 34 at an area close to the hosel. The rod 36 is fixedly connected to the tube 34 by the metallic disk or washer 42 which is shown soldered to the rod 36 and the inner surface 52 of the tube 34. The disk 42 provides a relatively rigid connection between the tube and rod at a location proximate to the club head. Again, although this embodiment has been preferred in early designs, empirical test results may dictate a different design.

At the opposite end of the shaft 22, the rod 36 is fixedly connected to the tube 34 at the grip 26. In the preferred embodiment shown, the rod 36 is fixedly connected to metallic washers 42 and 44. Thicker washers 44 are located near the bottom of the grip and near the top. The other washer 42 is located near a midpoint of the grip. These washers likewise provide a relatively rigid connection between the rod and tube at the grip. The rod 36 is shown terminating within the larger washer 44 and preferably is soldered thereto.

The metallic disks 42 and 44 preferably are made of a solderable material such as copper, brass, or iron and as such are substantially nonresilient. Accordingly, the rod 36 is soldered to the disks 42 and 44, and the disks are likewise brazed to the inner surface 52 of the tube 34. Alternatively, the disks 42 and 44 could be connected to the rod 36 and the tube 34 by other means such as a mechanical connection, friction fit, adhesive, brazing or welding. Additionally, other means of connection may permit other materials to be used for the disks 42 and 44 such as hard rubber, plastic, or phenolic. These alternate materials should be chosen so that the disks 42, 44 are substantially nonresilient.

The current design reflects embodiments which have been individually produced by hand. Mass production may require changing the steps for manufacturing the golf club and, accordingly, may dictate various changes to the design. Where such changes produce designs which incorporate the features and elements identified in the claims and equivalents thereof, those designs shall be considered a part of this invention.

A putter made according to this invention was subjected to impact loading and the resulting response of the shaft was measured. These tests identified vibration modes of the putter shaft due to impact loads on the head. The tests revealed a complex set of vibrational characteristics. Specifically, the tests identified nine modes of vibration, each mode being identified by a resonant frequency and a damping factor. The tests revealed that the club (incorporating the invention) has a low damping factor at low modal frequencies (modes 1–4) and a notably higher damping factor at modes associated with higher frequencies (modes 5–7). Mode 7 is a mode of torsional vibration and is insignificant when the golf club strikes the golf ball near its sweet spot. The test results are summarized below:

| | Club Incorporating Invention | |
|---|---|---|
| Mode | Frequency (Hz) | Damping (%) |
| 1 | 39.91 | 0.580 |
| 2 | 41.50 | 0.512 |
| 3 | 122.01 | 0.376 |
| 4 | 132.85 | 0.251 |
| 5 | 247.58 | 1.970 |
| 6 | 349.93 | 1.206 |
| 7 | 507.67 | 1.020 |
| 8 | 550.15 | 3.380 |
| 9 | 678.19 | 2.268 |

It is believed that the mode and damping characteristics of a golf club incorporating the present invention significantly contribute to the feel of the golf club and, hence, the feedback to the golfer. The golfer uses this feedback to make adjustments in subsequent shots to better control the accuracy of the putt or shot.

It is believed that the lower vibrational modes of the present golf club will die out less quickly than conventional clubs while the higher vibrational modes will die out more quickly. It is thus expected that the present club's response to ball impact is more heavily dominated by the lower vibrational modes relative to the response in conventional clubs. This theory might explain why the present invention appears to produce an action at ball impact that is less lively (i.e., the ball does not spring from the club face as much), giving the golfer a different "feel" more like pushing the ball than popping the ball and hence a higher level of control.

It will be appreciated that alternative theories and principles to explain the performance and feel of the present invention may apply.

Numerous characteristics and advantages of the invention have been set forth in the foregoing description, together with details of the structure and function of the invention. The novel features hereof are pointed out in the appended claims. The disclosure is illustrative only, and changes may be made in detail, especially in matters of shape, size, and arrangement of parts within the principle of the invention to the full extent indicated by the broad general meaning of the terms in the claims.

I claim:

1. A golf club comprising a shaft fixedly coupled to a grip and a head, the shaft including a tube having an inner surface, a rod fixedly located substantially coaxially within the tube, and a plurality of axially spaced disks fixedly arranged on the rod and in contact with the inner surface such that the disks are fixedly coupled to the rod and the inner surface, and the disks neither translate or expand relative to the rod, the disks including a plurality of substantially resilient disks.

2. The golf club of claim 1 wherein the resilient disks are substantially planar and include an outer margin having a plurality of lobes.

3. The golf club of claim 1 wherein the disks are substantially annular and include a centrally located opening for receiving the rod.

4. The golf club of claim 1 wherein the rod is fixedly coupled to the head and the grip.

5. The golf club of claim 1 wherein the rod is fixedly coupled to the grip, the head and to the tube proximate the head.

6. The golf club of claim 1 wherein the grip includes a nonperforated wall.

7. The golf club of claim 1 wherein the grip comprises a portion of the shaft.

8. A golf club comprising a shaft fixedly coupled to a grip and a head, the shaft including a tube having an inner surface, a rod located substantially coaxially within the tube, and a plurality of axially spaced disks arranged on the rod and in contact with the inner surface, the disks including a plurality of substantially resilient disks and at least one nonresilient disk located proximate the head, the nonresilient disk being fixedly coupled to the rod and the tube inner surface.

9. A golf club comprising a shaft fixedly coupled to a grip and a head, the shaft including a tube having an inner surface, a rod located substantially coaxially within the tube, and a plurality of axially spaced disks arranged on the rod and in contact with the inner surface, the disks including a plurality of substantially resilient disks and at least one nonresilient disk located proximate the grip, the nonresilient disk being fixedly coupled to the rod and the tube inner surface.

10. A golf club comprising a grip and a head connected by a shaft extending therebetween, the shaft including a tube and a rod, wherein the rod is fixedly coupled to the grip and the head, and further including at least one resilient disk located about the rod and in contact with an inner surface of the tube.

11. The golf club of claim 10 wherein the grip comprises a portion of the shaft.

12. The golf club of claim 10 wherein the grip comprises a nonperforated portion of the tube.

13. The golf club of claim 10 wherein the rod is further fixedly coupled to the tube at an area proximate the head.

14. The golf club of claim 10 wherein the rod is fixedly coupled to a nonresilient disk having an annular perimeter that is fixedly coupled to an inner surface of the tube proximate the head.

15. The golf club of claim 10 wherein the rod is a metal comprised primarily of copper and the tube is a ferric metal.

16. A golf club comprising a grip and a head connected by a shaft extending therebetween, the shaft including a tube and a rod, wherein the rod is fixedly coupled to the grip and the head, and further including at least one resilient disk located about the rod and in contact with an inner surface of the tube and wherein the rod is coupled to the grip by a coupling comprising at least one nonresilient disk that is located coaxially about the rod and is fixedly connected to the grip.

17. A golf club comprising a shaft and a head fixedly coupled thereto, the shaft being fixedly coupled to a grip having a nonperforated wall, the shaft including a tube and a rod located substantially coaxially within the tube, the rod being fixedly coupled to the head and the grip.

18. The golf club of claim 17 wherein the grip is a portion of the tube.

19. The golf club of claim 17 further comprising a plurality of disks coupled to the rod and in contact with an inner surface of the tube.

20. The golf club of claim 17 further comprising a plurality of resilient disks located about the rod and in contact with an inner surface of the tube.

21. The golf club of claim 17 further comprising a plurality of resilient disks located about the rod and in contact with an inner surface of the tube and a plurality of substantially nonresilient disks located about the rod and fixedly coupled to the inner surface of the tube within the grip portion.

22. A golf club comprising a shaft having a grip portion at one end thereof and a head fixedly attached at an opposed end thereof, the shaft including a tube and a rod, the rod being arranged substantially coaxially within the tube wherein the rod is fixedly coupled to the grip portion by at least one substantially nonresilient coupler located at a spaced apart location from an end of the grip portion, and the rod is fixedly coupled to the head by at least one substantially nonresilient coupler, such that vibrations generated at the head are communicated to the grip portion by the tube, rod and the nonresilient couplers.

23. The golf club of claim 22 further comprising a resilient disk having a centrally located aperture through which the rod is received, the disk having an annular perimeter that is at least partially in contact with an inner surface of the tube.

24. The golf club of claim 22 wherein the rod is coupled to the grip portion by nonresilient disks that are fixedly coupled to the rod and the grip portion of the shaft.

25. The golf club of claim 22 wherein no portion of the rod is in direct communication with the ambient environment outside the shaft.

26. The golf club of claim 22 further comprising a plurality of resilient disks and nonresilient disks, the nonresilient disks being axially spaced on the rod to provide at least one coupling connection between the rod and grip portion and at least one fixed coupling connection between the rod and a portion of the tube proximate the head, and the resilient disks being coupled to the rod and in contact with an inner surface of the tube such that impacts to the head are at least partially attenuated by the resilient disks.

27. The golf club of claim 22 further comprising a plurality of resilient disks and nonresilient disks, the nonresilient disks being fixedly coupled to the rod and fixedly coupled to the grip portion and the resilient disks being coupled to the rod in contact with an inner surface of the tube such that impacts to the head are vibrationally communicated to the grip portion by the rod and the nonresilient disks, and wherein higher vibrational modes are more attenuated than lower vibrational modes.

28. A golf club comprising a shaft having a grip portion at one end thereof and a head fixedly attached at an opposed end thereof, the shaft including a tube and a rod, the rod being arranged substantially coaxially within the tube wherein the rod is coupled to both the grip portion and head by at least one substantially nonresilient coupler, such that vibrations generated at the head are communicated to the grip portion by the tube, rod and the nonresilient couplers and further comprising at least one attenuation coupler coupled to the rod and in damping communication with the tube.

29. A golf club comprising:

a shaft having first and second ends;

a head rigidly secured to the shaft at the first end;

a grip located proximate the second end and including a portion of the shaft;

the shaft including a tubular member with an inner bore wall and a rod member disposed substantially coaxially within the tubular member; and the rod member being coupled to the tubular member proximate the head by a first rigid support member in contact with both the rod member and the inner bore wall, proximate the grip by a second rigid support member in contact with both the rod member and the inner bore, and along the tubular member by a plurality of resilient support members each in contact with both the rod and the inner bore wall, the resilient support members being disposed in spaced apart relationship between the first and second rigid members.

* * * * *